US007566294B2

(12) United States Patent
Amirkhanian et al.

(10) Patent No.: US 7,566,294 B2
(45) Date of Patent: Jul. 28, 2009

(54) SPIRAL VANE INSERT FOR A CENTRIFUGE

(75) Inventors: Hendrik N. Amirkhanian, Cookeville, TN (US); Peter K. Herman, Cookevillke, TN (US); Jessil Joseph, Cookeville, TN (US); Gerard Malgorn, Quimper (FR); Jean-Luc Guichaoua, Combrit (FR); Benoit LeRoux, Fouesnant (FR)

(73) Assignee: Cummins Filtration IP Inc., Minneapolis, MN (US)

( * ) Notice: Subject to any disclaimer, the term of this patent is extended or adjusted under 35 U.S.C. 154(b) by 225 days.

(21) Appl. No.: 11/333,427

(22) Filed: Jan. 17, 2006

(65) Prior Publication Data

US 2008/0132396 A1 Jun. 5, 2008

Related U.S. Application Data

(60) Provisional application No. 60/661,295, filed on Mar. 11, 2005.

(51) Int. Cl.
*B04B 1/04* (2006.01)
*B04B 9/06* (2006.01)

(52) U.S. Cl. ..... 494/75; 494/49

(58) Field of Classification Search ..... 494/44, 494/49, 67, 74–75

See application file for complete search history.

(56) References Cited

U.S. PATENT DOCUMENTS

| | | | | |
|---|---|---|---|---|
| 1,208,960 | A * | 12/1916 | Hedderich | 494/75 |
| 5,575,912 | A | 11/1996 | Herman et al. | |
| 5,637,217 | A | 6/1997 | Herman et al. | |
| 6,017,300 | A | 1/2000 | Herman | 494/49 |
| 6,019,717 | A | 2/2000 | Herman | 494/49 |
| 6,183,407 | B1 * | 2/2001 | Hallgren et al. | 494/49 |
| 6,200,252 | B1 * | 3/2001 | Hallgren et al. | 494/49 |
| 6,540,653 | B2 * | 4/2003 | Herman et al. | 494/49 |
| 6,551,230 | B2 * | 4/2003 | Herman et al. | 494/75 |
| 6,602,180 | B2 * | 8/2003 | Herman et al. | 494/75 |
| 6,652,439 | B2 * | 11/2003 | Herman et al. | 494/75 |
| 7,182,724 | B2 * | 2/2007 | South | 494/49 |
| 7,189,197 | B2 * | 3/2007 | Curt et al. | 494/49 |
| 7,377,893 | B2 * | 5/2008 | Herman et al. | 494/49 |

FOREIGN PATENT DOCUMENTS

WO WO 2006099565 A2 * 9/2006

* cited by examiner

*Primary Examiner*—Charles E Cooley
(74) *Attorney, Agent, or Firm*—Hamre, Schumann, Mueller & Larson, P.C.; J. Bruce Schelkopf

(57) ABSTRACT

A removable, spiral vane insert for receipt by a centrifuge rotor enclosure includes a unitary, molded plastic spiral vane portion including a spiral vane module and a baseplate that are all integrally joined together. The spiral vane portion further includes a tubular sleeve having a longitudinal axis corresponding to the axis of rotation for the rotor.

18 Claims, 9 Drawing Sheets

SPIRAL VANE INSERT FOR A CENTRIFUGE

CROSS REFERENCE TO RELATED APPLICATIONS

The present application claims the benefit of U.S. Provisional Patent Application Ser. No. 60/661,295, filed Mar. 11, 2005 entitled "Spiral Vane Insert For A Centrifuge" which is hereby incorporated by reference in its entirety.

BACKGROUND OF THE INVENTION

The present invention relates in general to the rotor design for a fluid centrifuge that is constructed and arranged to separate undesired particulate matter out of a fluid. Typical of such fluid centrifuge designs is the use of an outer centrifuge housing or shell that defines a hollow interior. A rotor is positioned within the hollow interior and is constructed and arranged to rotate at a high (RPM) rate relative to the centrifuge housing. Various arrangements of bearings, bushings, shafts, and shaft spuds have been used to enable this relative rotary spinning of the rotor within the centrifuge housing. One design variation for centrifuge rotors of the type being discussed herein is to use the exiting fluid for driving the rotor (i.e., self-driven) via one or more tangential nozzles.

Positioned within the rotor is a particulate separating subassembly that is constructed and arranged to improve the separating efficiency of the rotor. Over the years, a number of designs have been tried to perform the particulate separating function. One particulate separating subassembly design used by Fleetguard, Inc. of Nashville, Tenn., is a stack of closely spaced cones identified by their "ConeStac" trademark and disclosed in various U.S. patents, such as U.S. Pat. No. 5,575,912, issued Nov. 19, 1996 to Herman, et al.; U.S. Pat. No. 5,637,217, issued Jun. 10, 1997 to Herman et al.; and U.S. Pat. No. 6,017,300, issued Jan. 25, 2000 to Herman.

Another particulate separating subassembly design used by Fleetguard, Inc. is a spiral vane that includes a series of curved (spiral) vanes radiating from a central hub. The spiral vanes rotate as part of and with the rotor assembly at a high (RPM) rate. The centrifugal forces exerted on the heavier particulate cause this particulate to separate out from the fluid being processed by the centrifuge. Spiral vane designs are disclosed in various U.S. patents, such as U.S. Pat. No. 6,551,230, issued Apr. 22, 2003 to Herman et al.

Whether considering a cone stack design or a spiral vane design, typically there is a baseplate as part of the rotor assembly and an interface between the particulate separating subassembly and the baseplate that needs to be sealed. If leakage through this interface is allowed to occur, then collected particulate matter (i.e., soot or sludge) is washed out of the rotor and re-entrained into the fluid being processed. This means reduced efficiency and a consequence that is regarded as detrimental.

If this interface between the particulate separating subassembly and the baseplate can be effectively sealed to eliminate any risk of leakage, it would constitute a rotor design improvement. The present invention addresses this design challenge by creating a unitary combination of the particulate separating subassembly and the baseplate. By molding or casting these two portions into a one-piece, unitary component, there is no interface to be sealed and no risk of leakage at that interface. The fabrication of a single component, as compared to two components (spiral vane and baseplate) that have to be assembled, represents a cost savings and in the case of the present invention, a savings in terms of cleaning and servicing. The present invention thus results in an improved part configuration in terms of rotor efficiency and an improved part configuration in terms of cost. Other design features are disclosed as part of the present invention that add improvements and value to the structure.

In non-disposable (take-apart, cleanable) rotor designs, the user has to clean the internal components of the rotor and separate the collected contaminant from those components. This process is time consuming and typically requires a chemical wash station. The present invention allows the user to quickly and easily remove the "capsule" containing the contaminant, which saves time and cost, eliminates the need for parts washing, and is a clean process (i.e., the contaminant is contained).

BRIEF SUMMARY OF THE INVENTION

A removable, spiral vane insert for receipt by a rotor of a fluid-processing centrifuge according to one embodiment of the present invention comprises in combination, a cover housing, and a unitary, molded plastic body that includes a spiral vane module and a baseplate. The cover housing is assembled to the baseplate to create an enclosed insert. The fluid-processing centrifuge includes a centrifuge housing and the rotor has an axis of rotation relative to the centrifuge housing. The spiral vane module includes a tubular sleeve having a longitudinal axis corresponding to the axis of rotation of the rotor.

One object of the present invention is to provide an improved, removable, spiral vane insert for a centrifuge.

Related objects and advantages of the present invention will be apparent from the following description.

DETAILED DESCRIPTION OF THE INVENTION

Figure 1:
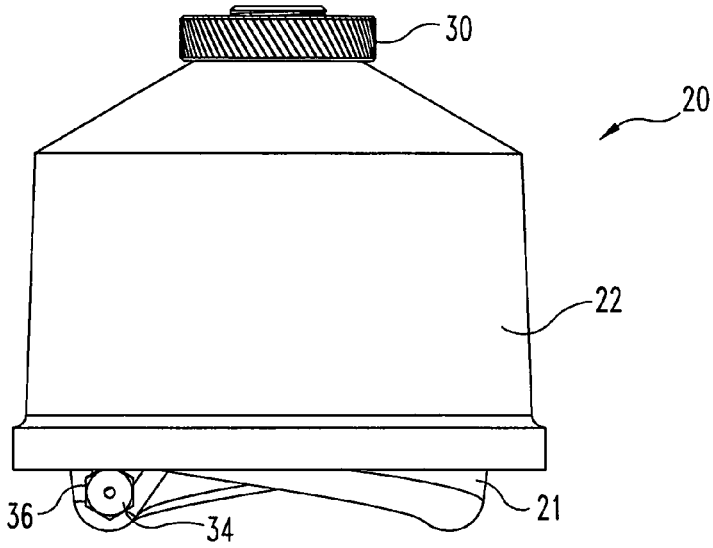
FIG. 1 is a front elevational view of a rotor assembly that includes a spiral vane insert according to a typical embodiment of the present invention.
Figure 2:
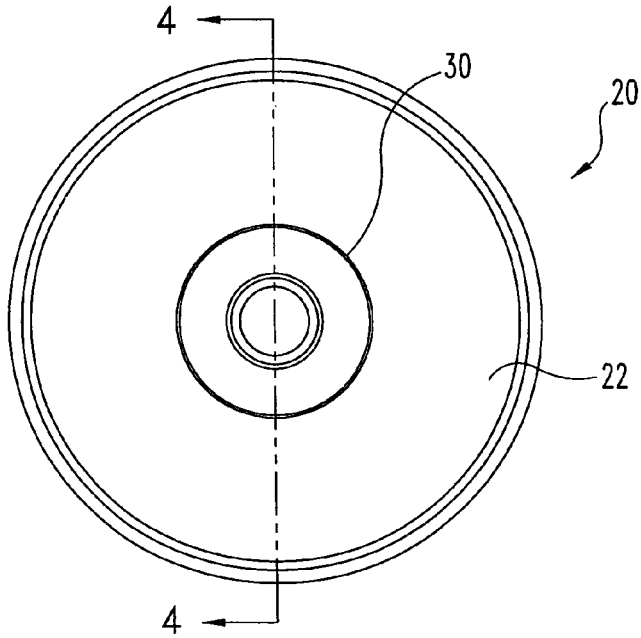
FIG. 2 is a top plan view of the FIG. 1 rotor assembly.

For the purposes of promoting an understanding of the principles of the invention, reference will now be made to the embodiments illustrated in the drawings and specific language will be used to describe the same. It will nevertheless be understood that no limitation of the scope of the invention is thereby intended, such alterations and further modifications in the illustrated device, and such further applications of the principles of the invention as illustrated therein being contemplated as would normally occur to one skilled in the art to which the invention relates.

Referring to FIGS. 1-5, there is illustrated a rotor assembly 20 according to one embodiment of the present invention. Rotor assembly 20 includes, among other components, a rotor base 21 and a rotor housing 22 that together cooperate to create a rotor enclosure that defines a hollow interior. Positioned within this hollow interior is a spiral vane insert 23 that is part of rotor assembly 20 and includes a unitary, spiral vane portion 24 and a unitary, insert liner or housing 25. The spiral vane portion 24 includes, as a unitary combination, a spiral vane module 26 and a baseplate 27. The housing 25 is securely and permanently connected to baseplate 27 so as to enclose the spiral vane module 26. An annular O-ring seal 28 and threaded nut 30 complete the rotor assembly 20. As will be described, the spiral vane insert 23 is designed to be removable for disposal once it collects its designed volume of sludge from the fluid filtration and fluid processing that is performed by the spiral vane module 26. As will be described, the fluid to be processed, typically oil, is introduced through a rotor assembly centertube and flows upwardly into the spiral vane module 26 wherein it is processed to separate out the heavier particulate. This heavier particulate collects along the inside surface of housing 25 and the processed fluid then exits from the spiral vane insert and is used for driving the rotation of the rotor assembly.

Figure 4:
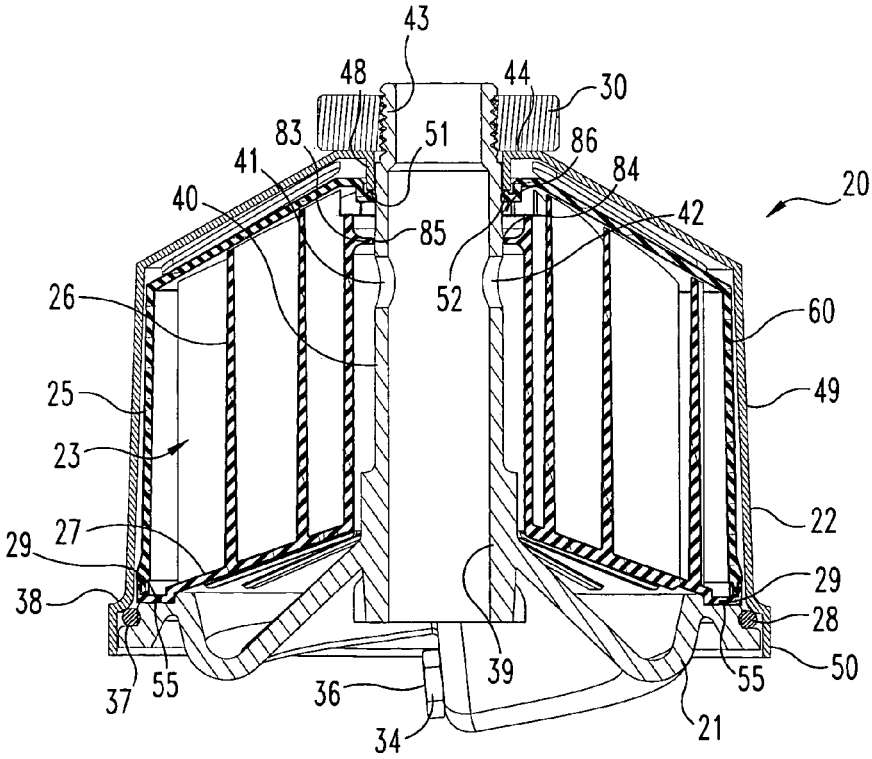
FIG. 4 is a front elevational view, in full section, of the FIG. 1 rotor assembly as viewed along line 4-4 in FIG. 2.
Figure 5:
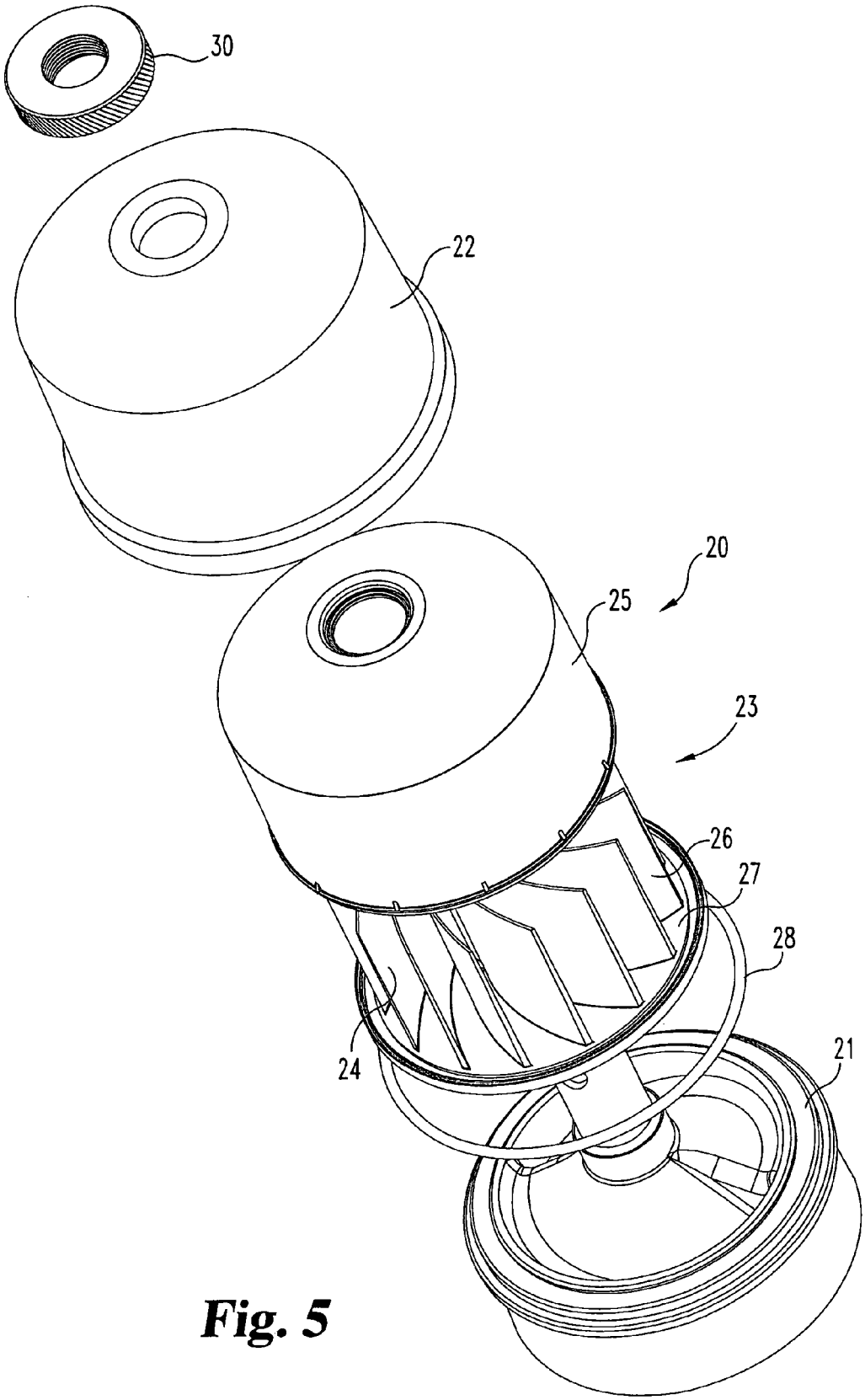
FIG. 5 is an exploded view of the FIG. 1 rotor assembly.
Figure 6:
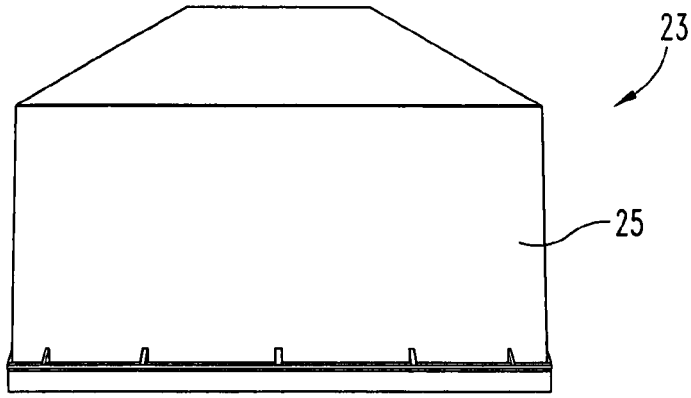
FIG. 6 is a front elevation view of a spiral vane insert comprising a portion of the FIG. 1 rotor assembly according to the present invention.
Figure 7:
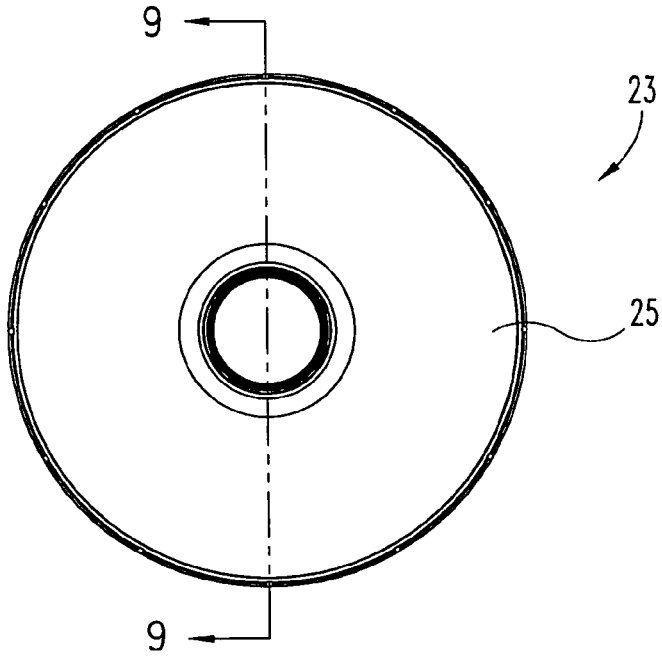
FIG. 7 is a top plan view of the FIG. 6 spiral vane insert.
Figure 8:
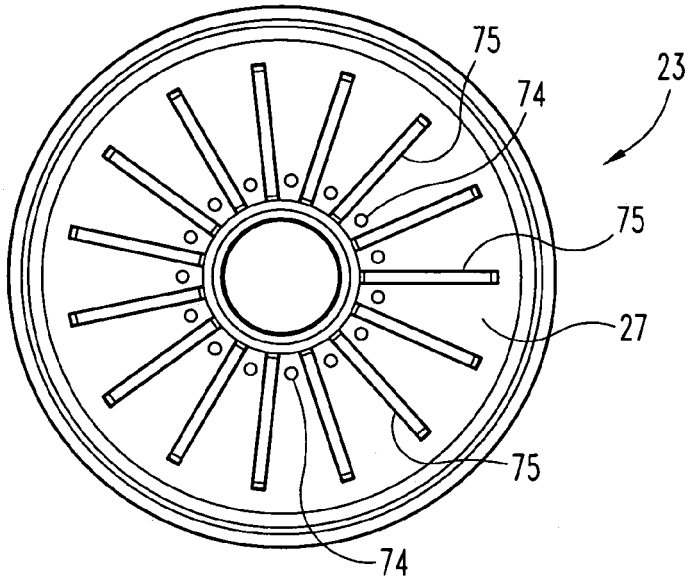
FIG. 8 is a bottom plan view of the FIG. 6 spiral vane insert.

In the FIG. 4 illustration, it will be seen that while the spiral vane module 26 and baseplate 27 are constructed as a unitary (single) member, neither component part (either module 26 or baseplate 27) is unitarily connected with housing 25. Instead, the connection with housing 25 is by means of baseplate 27 that defines an annular groove or channel-like slot 72 that receives annular protrusion 73 extending from the lower edge of housing 25.

Figure 10:
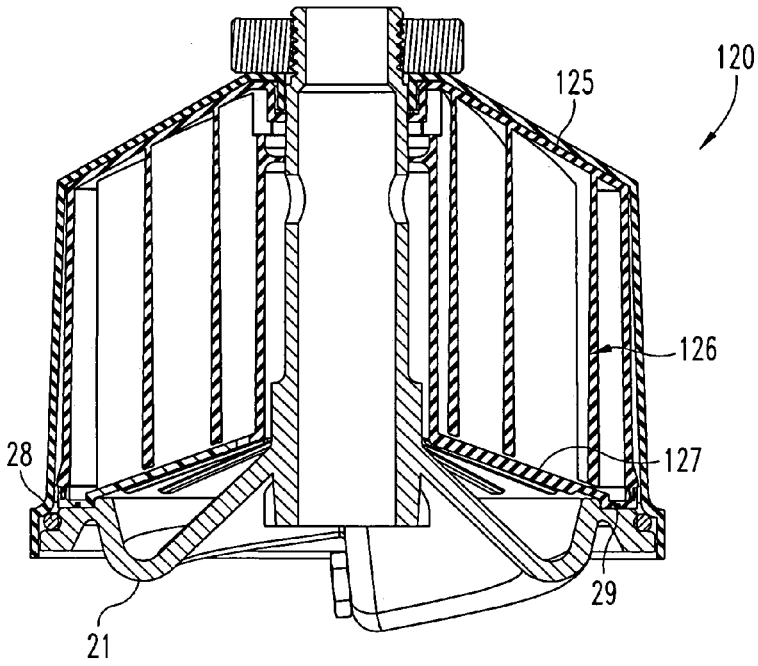
FIG. 10 is a front elevation view, in full section, of an alternative rotor assembly to that illustrated in FIG. 4, according to the present invention.

An alternate embodiment of the present invention is illustrated in FIG. 10 wherein rotor assembly 120 includes a spiral vane module 126 and housing 125 that are constructed as a unitary (single) member and connected to the baseplate 127 which is now designed as a separate component part from spiral vane module 126. The remainder of the FIG. 10 structure is substantially the same as the structure of FIG. 4.

Figure 3:
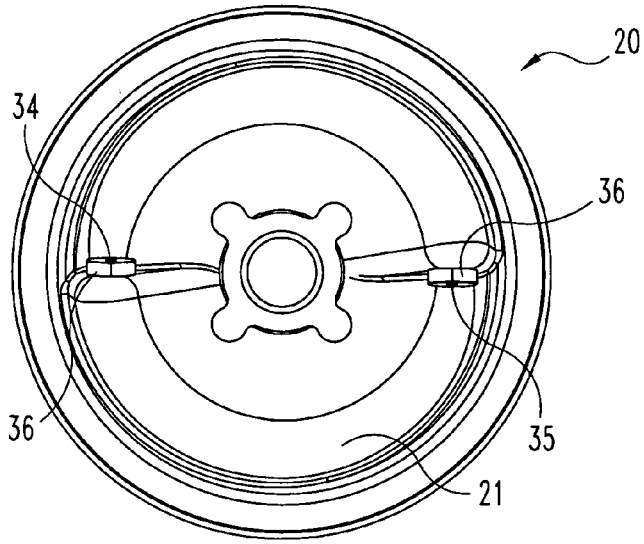
FIG. 3 is a bottom plan view of the FIG. 1 rotor assembly.

As illustrated in FIGS. 3 and 4, the rotor base 21 is configured with an opposed pair of tangential flow jet nozzles 34 and 35. Each nozzle 34 and 35 is created by the use of an externally-threaded plug 36 that is received by a corresponding internally-threaded port in rotor base 21. The exposed end of each plug defines a flow jet opening for the exiting fluid. This exiting fluid, by way of the nozzles 34 and 35, creates the mentioned self-driven rotor assembly. An acceptable alternative construction for nozzles 34 and 35 is to integrally form (mold) these openings into rotor base 21.

With continued reference to FIG. 4, it will be seen that the O-ring seal 28 is positioned between the rotor base 21 and the rotor housing 22. The O-ring seal 28 is captured by annular shelf 37 and compressed between shelf 37 and shoulder 38. The unitary rotor base 21 includes a cylindrical rotor hub portion 39 extending upwardly into a cylindrical rotor centertube 40. The rotor centertube 40 defines a pair of flow outlet openings 41 and 42 and terminates at externally-threaded end 43. These two openings 41 and 42 can alternatively be provided by several holes or apertures. End 43 extends beyond the upper surface 44 of rotor housing 22 and receives threaded nut 30. As the threaded nut 30 is manually tightened onto end 43, the nut 30 pushes down on upper surface 44 and draws upwardly on centertube 40. These forces in turn cause the cooperation between shoulder 38 and shelf 37 to compress the O-ring seal 28 therebetween for an annular, sealed interface between rotor base 21 and rotor housing 22 at that location. In the preferred embodiment of the present invention, the rotor base 21 and rotor housing 22 are of a metal construction so as to be both strong and reliable and importantly reusable for multiple spiral vane inserts.

Rotor housing 22 is cylindrically symmetrical and includes a cylindrical sleeve portion 48 that extends inwardly from upper surface 44 and is centered and axially concentric with inner sidewall 49 and outer skirt 50. The lower edge 51 of sleeve portion 48 contacts a raised annular rib 52 that is part of spiral vane housing 25. This edge-to-rib abutment will be described in greater detail in conjunction with a more detailed description of the spiral vane insert 23.

Rotor base 21 includes an annular recess surface 55 that is used to help align and support the spiral vane insert 23 as it slides over rotor centertube 40 and seats onto rotor base 21. While the use of annular O-ring seal 28 is designed to provide an annular sealed interface to prevent any fluid leakage between housing 25 and rotor base 21, additional sealing is provided by placing annular O-ring seal 29 between baseplate 27 and surface 55 of rotor base 21.

The sizing of sidewall 60 of spiral vane housing 25 relative to the sizing of the inner sidewall 49 is such that these portions are assembled into close proximity with each other. This is why housing 25 can be thought of or considered as a "liner" for the rotor housing 22. While a line-to-line fit is not required, a very close proximity with a minimal clearance space therebetween is intended. This close proximity is important as described below. When the rotor is pressurized and full of oil, there is some outward expansion of the spiral vane housing due to the centrifugal forces on the liner. By positioning the inner sidewall 49 in close proximity to housing 25, the metal rotor housing is able to function as a back-up support structure for the spiral vane housing 25 so as to stop or prevent any further expanding of the spiral vane housing 25. The closer the spacing between the sidewall 49 and housing 25 and in turn the smaller the clearance gap, the less expansion will be permitted of the spiral vane housing. A benefit of using the metal rotor housing 22 as a back-up support structure is that it enables the use of a spiral vane insert 23, primarily the housing 25, that does not have to be as structurally strong as would otherwise be required without this back-up feature.

Referring now to FIGS. 6 through 9, the details of spiral vane insert 23 are illustrated, according to the present invention. Spiral vane insert 23 is used as part of rotor assembly 20 that is assembled into a fluid-processing centrifuge for separating particulate matter out of the fluid being processed. As described herein, the spiral vane insert 23 includes spiral vane portion 24 and housing 25. The spiral vane portion 24 includes, as a unitary combination, the spiral vane module 26 and baseplate 27. In one embodiment of the present invention, the spiral vane portion 24 is a molded plastic component that is constructed and arranged to be enclosed by molded plastic housing 25. A suitable material for the unitary molding of spiral vane portion 24 is non-filled, high-flow, temperature-resistant nylon, such as DuPont 103 FHS. A suitable material for the unitary molding of housing 25 is non-filled, high-flow, temperature-resistant nylon, such as DuPont 103 FHS. By designing spiral vane insert 23 to be easily inserted into the rotor enclosure and easily removed from the rotor enclosure, the periodic servicing of the centrifuge is simplified. The referenced rotor enclosure is the separable combination of the rotor base 21 and rotor housing 22.

The construction and arrangement of the spiral vane portion 24 provides enhanced particulate separation as compared to various prior art constructions. Accordingly, the replacement of less efficient prior art designs by the disclosed spiral vane concept provides an additional improvement in terms of filtration efficiency. For those prior art designs with less efficient filtration (i.e., particulate separation), use of insert 23 provides enhanced filtration and improved ease of service.

Figure 9:
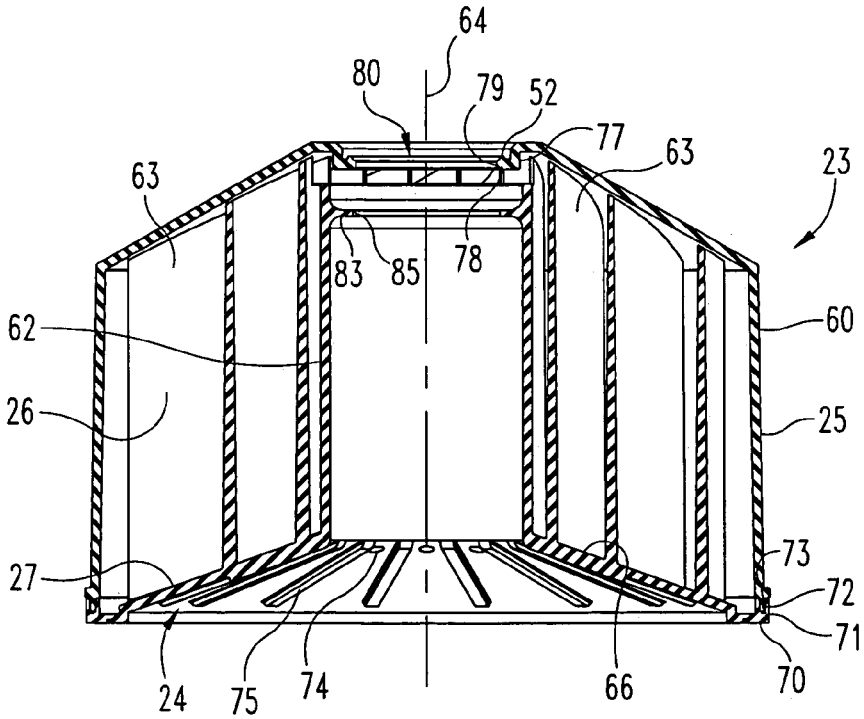
FIG. 9 is a front elevational view, in full section, of the FIG. 6 spiral vane insert as viewed along line 9-9 in FIG. 7.

Spiral vane portion 24 includes a central tubular sleeve 62 that can be considered a part of the spiral vane module 26 or a part of the baseplate 27 as it is in unitary construction with both. Radiating outwardly from sleeve 62 are a series of twelve (12) curved, spiral vanes 63. This number of vanes is a compromise between manufacturing costs and separation efficiency. A larger number of vanes improves performance of the rotor, but introduces manufacturing and cost issues. Sleeve 62 is a generally cylindrical tube with a longitudinal centerline 64 that coincides with the axis of rotation for the corresponding rotor assembly 20, relative to the centrifuge housing (not illustrated). The curvature geometry of each vane 63 is substantially the same. While the spacing distance between adjacent vanes 63 is progressively wider as the vanes extend radially outwardly, the spacing between adjacent pairs of vanes is substantially the same at each radial dimension. Each vane 63 extends upwardly from baseplate 27 in a substantially straight direction such that the illustrated edge lines in the full section view of FIG. 9 show up as straight vertical lines (edges) that are parallel to longitudinal centerline 64. The concept, construction, and performance of a spiral vane design for a fluid centrifuge is disclosed in U.S. Pat. No. 6,551,230, issued Apr. 22, 2003 to Herman et al. The '230 patent is hereby expressly incorporated by reference for its entire disclosure.

Housing 25 includes a substantially cylindrical sidewall 60 whose longitudinal axis coincides with longitudinal centerline 64. This assures the uniformity and balance to the corresponding rotor that ultimately receives spiral vane insert 23 such that the rotor assembly is able to rotate at a high (RPM) rate without out-of-round or dynamic balance issues.

With continued reference to FIGS. 6-9, it is to be understood that the outer edge of each spiral vane 63 is positioned in close proximity to the inner surface of sidewall 60, such that there is a minimal separation between these two portions at that location. The separated particulate matter (i.e., sludge) is able to collect on the inner surface of sidewall 60 until servicing. When the amount of sludge accumulation reaches the servicing level, or at a predetermined period of time (service interval), the insert 23 is manually removed from the rotor enclosure and disposed of in an appropriate manner. An appropriate manner in this instance can be incineration of the entire insert 23. With a molded plastic construction, another option for disposal in an appropriate manner is to recycle the plastic that is used in the construction of insert 23. A new, clean insert is then inserted into the rotor housing in order to continue with centrifuge operation. Removal is achieved by manually removing threaded nut 30 and separating rotor housing 22 from the rotor base 21.

By constructing insert 23 as a removable/replaceable subassembly of the rotor assembly 20, nothing else that may be part of the rotor assembly, such as the rotor housing and any bushings or bearings, has to be replaced when the insert is discarded at the time of servicing. As contrasted to those designs where the entire rotor assembly is disposed of, the replacement of only insert 23 provides a lower cost design since the remainder of the rotor assembly is intended to be reused with a new (i.e., clean) spiral vane insert 23.

Baseplate 27 includes a frustoconical lower shelf 66, a support portion 70, and an outer wall 71. The support portion 70 fits into recessed surface 55 for positioning the spiral vane insert 23 onto rotor base 21. As previously noted, the location of annular surface 55 provides an area for the addition of O-ring 29 as an added seal. The outer wall 71 includes an annular blind, channel-like slot 72 that receives an annular protrusion 73 extending from the lower edge of housing 25. Protrusion 73 fits securely into slot 72 and is sealed in place preferably by spin welding. As an alternative joining technique for protrusion 73 and slot 72, a suitable adhesive can be used.

The lower shelf 66 defines a plurality of flow holes 74 for the fluid being processed to exit from the insert 23. In a self-driven rotor design, this exiting fluid is directed to the two flow nozzles 34 and 35 of rotor base 21. Each flow hole 74 is located in close proximity to the outer surface of sleeve 62 and spaced between adjacent vanes 63. What would in essence be the lower edge portion of each vane is integral with the upper surface of lower shelf 66. However, since insert 23 is a unitary, molded plastic component, it is sufficient to describe that the vane portions are integrally joined to the upper surface of lower shelf 66 such that there is no void or opening at any interface, except for the flow holes 74. The undersurface of lower shelf 66 includes, in unitary construction, a series of fifteen strengthening ribs 75.

One advantage of integrating the sleeve 62, spiral vanes 63, and baseplate 27 as a unitary component is the elimination of any required assembly of these portions or components to each other. Further, since all of these portions or components are intended to rotate together as a unit, at a high (RPM) rate for proper centrifuging, any concentricity mismatch, even if fairly minor, can show up as a dynamic balance issue. The concerns over the concentricity of these components when separately assembled together are eliminated by the unitary construction for insert 23. The same is true if the spiral vane 26 and housing 25 are fabricated as a single, unitary member.

One embodiment of the unitary housing 25 includes an annular inner wall 77 and an annular radial flange 78. The upper surface of flange 78 includes annular rib 52 that has a tapered cross sectional shape. The sleeve portion 48 extends into the cylindrical opening defined by inner wall 77. Lower edge 51 is drawn into compression against the tip of rib 52. This arrangement utilizes the rotor housing to constrain the spiral vane insert from moving axially and prevents sludge deposits from forming in the gap between liner shell 60 and shell 22 which could hinder the desired ease of service. Annular radial flange 78 includes a circular edge 79 defining a centered circular opening 80. Edge 79 is sized and shaped to seal against the outer surface of rotor centertube 40.

With reference to FIG. 4, it will be appreciated that the incoming fluid (i.e., oil) flows upwardly through centertube 40 exiting by way of flow outlet openings 41 and 42. The tubular sleeve 62 includes a radial flange 83 that has a split ring configuration and defines a small clearance gap 84 between its inner edge 85 and the outer surface of centertube 40. The percentage (1.0-50.0%) of flow that the split ring allows to flow upwardly through gap 84 is able to flow throughout the spiral vanes 63 of module 26 by way of openings 86 in the upper portion of sleeve 62. The larger percentage of flow (50.0-99.0%) is diverted directly to the drive jets nozzles 34 and 35 and bypasses the collection chamber. This concept is described more fully in U.S. Pat. No. 6,454,694, issued Sep. 24, 2002 to Herman et al., and which is expressly incorporated by reference herein. The design configuration of the '694 structure serves to increase the separation efficiency of the rotor for very small particles.

Figure 11:
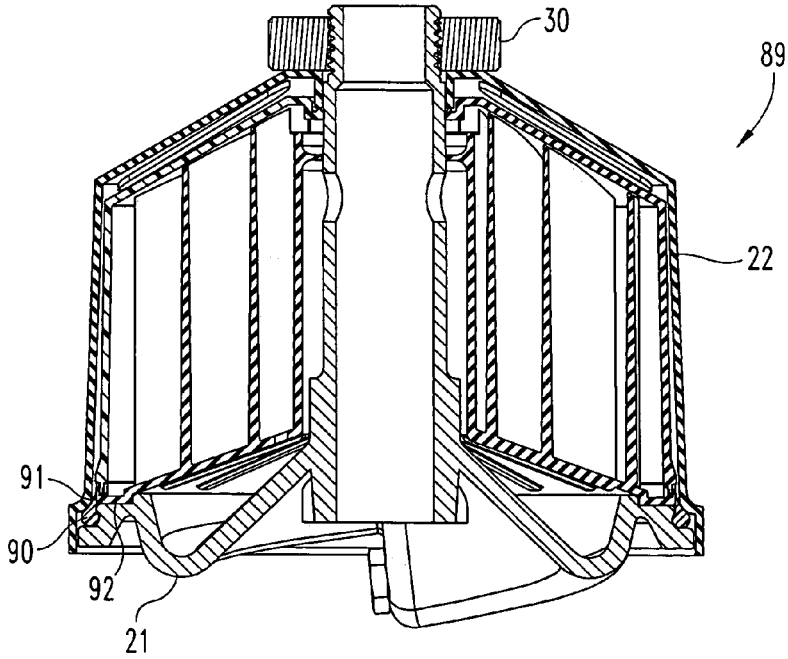
FIG. 11 is a front elevation view, in full section, of a rotor assembly according to yet another embodiment of the present invention.

A further embodiment for the spiral vane insert of the present invention is illustrated in FIG. 11. The O-ring seal 28 used as part of rotor assembly 20 is replaced in rotor assembly 89 by a molded rubber gasket 90 that is co-molded with the baseplate 27 (nylon), now baseplate 92. O-ring seal 29 is not used in this embodiment. The function and advantage of an integral/co-molded gasket is significant. It not only provides the internal-external seal of an O-ring, but it also eliminates the need for "wiper blade" (or close proximity fit, which is difficult to achieve due to molding tolerances) to prevent sludge deposition in the vertical annulus between shell and liner (and associated hindered service). As illustrated in FIG. 11, the gasket 90 has a generally circular cross sectional shape and depends from the outer annular edge 91 of baseplate 92. With this design difference as noted, the remainder of rotor assembly 89 is substantially the same as rotor assembly 20.

The co-molded construction of gasket 90, making it integral with baseplate 92, represents an alternative design to the use of a separate and distinct O-ring 28 as contemplated by the present invention. This alternative (i.e., gasket 90) may be combined with the use of the second O-ring 29 for sealing against surface 55 as one variation (see FIG. 12) or without O-ring 29 as a second variation (see FIG. 11). The addition of O-ring 29 requires a channel and thus a new baseplate 92*a*. These same variations or options exist when O-ring 28 is used, for a total of four (4) permutations in terms of the O-ring/gasket combination. While only the O-ring 28, O-ring 29 combination is illustrated (see FIG. 4), it will be understood that the fourth permutation is achieved by simply removing O-ring 29 from the FIG. 4 illustration.

Figure 12:
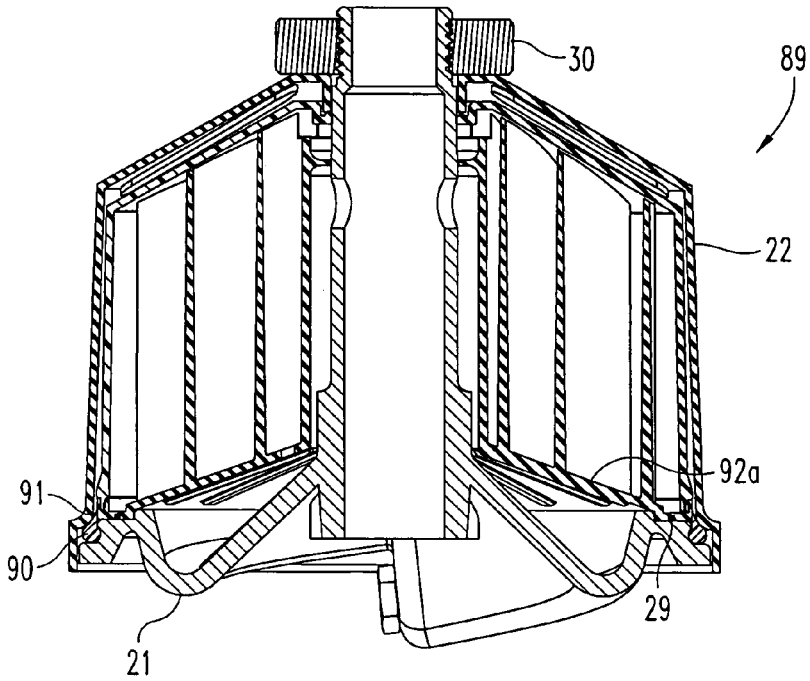
FIG. 12 is a front elevational view, in full section, of a rotor assembly according to yet another embodiment of the present invention.
Figure 13:
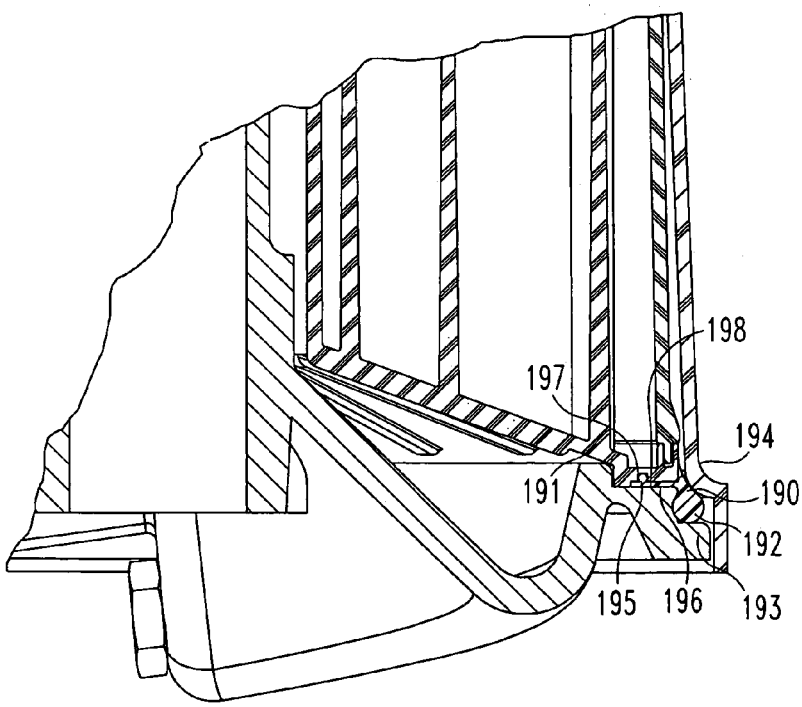
FIG. 13 is a front elevational view, in full section, of a rotor assembly according to yet another embodiment of the present invention.

With reference to FIG. 13, a still further alternative embodiment is illustrated. In the FIG. 13 rotor, the gasket 90 and O-ring 29 combination of FIG. 12 is created using a single (unitary) annular gasket 190. Whether co-molded with baseplate 191 or fabricated as a separate and distinct component that is assembled into position, gasket 190 provides sealing at both of those interfaces previously discussed. The rotor base portion 192 of gasket 190 is constructed and arranged to seal between the rotor base 193 and the outer housing 194. The O-ring portion 195 of gasket 190 is constructed and arranged to seal between baseplate 191 and surface 196 of rotor base 193. The baseplate 191 is formed with an annular receiving channel 197 for receipt of O-ring portion 195. Portions 192 and 195 are connected by web portion 198.

Figure 15:
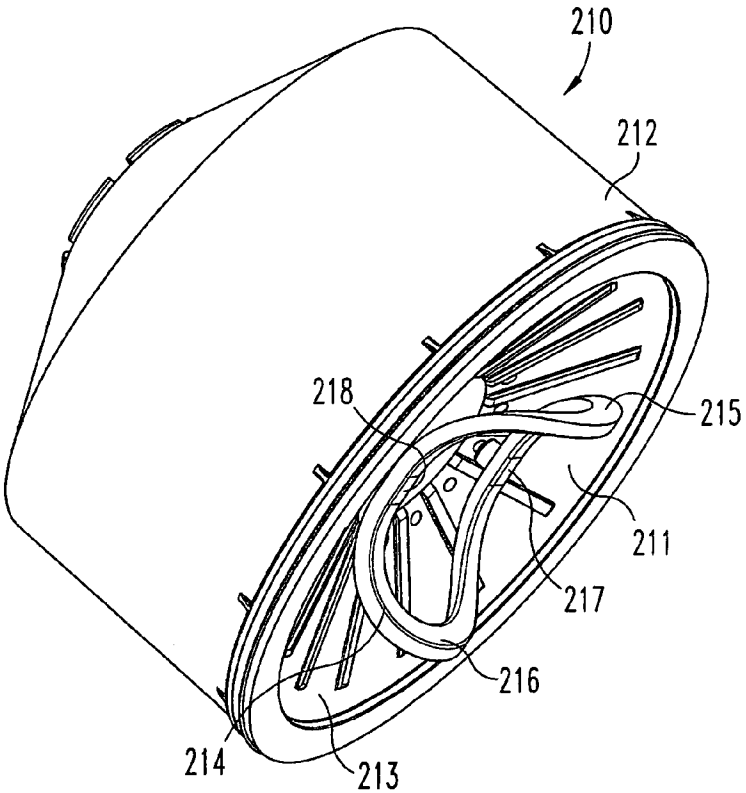
FIG. 15 is a perspective view of the FIG. 14 rotor assembly with the handle flexed for grasping.
Figure 14:
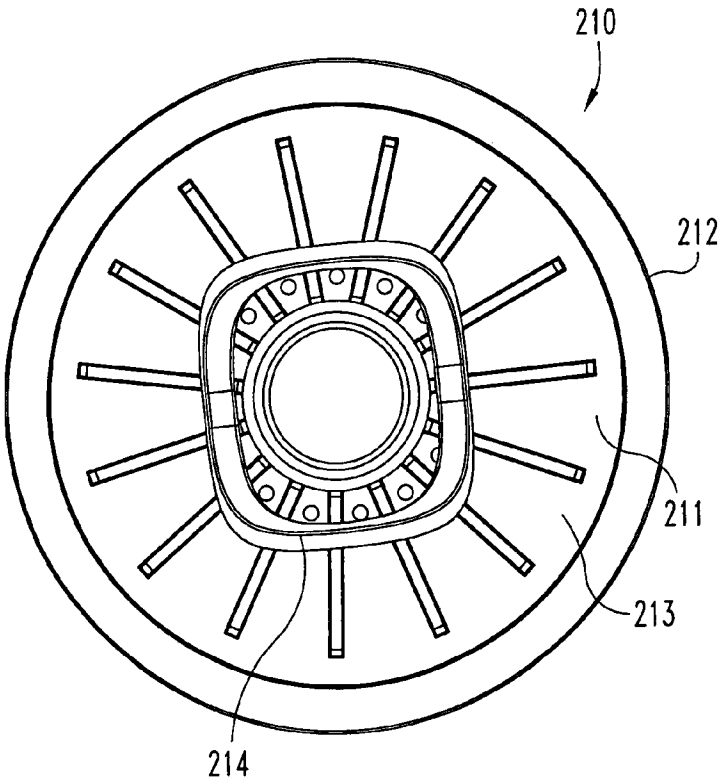
FIG. 14 is a bottom plan view of a rotor assembly incorporating a removal handle according to the present invention.
Figure 16:
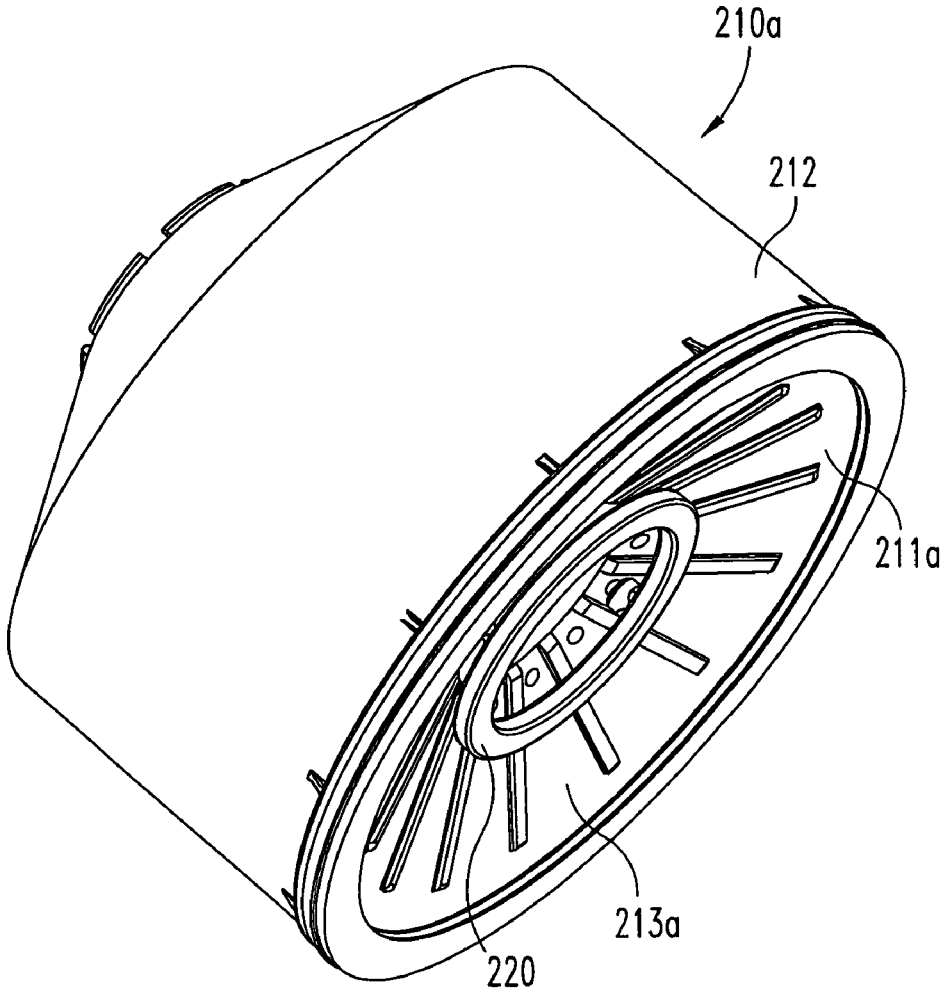
FIG. 16 is a perspective view of another embodiment for the FIG. 14 rotor assembly having a different handle shape.

Referring to FIGS. 14, 15 and 16, another feature of the present invention is illustrated. For the purposes of explaining the inventive feature represented by FIGS. 14-16, a generic rotor assembly 210 (and 210*a* in FIG. 16) is illustrated and is intended to represent all of those various embodiments disclosed in FIG. 1-13. The focus of FIG. 14-16 is the removal of the rotor assembly 210 (or 210*a*), including whatever particulate separation means is include therein, as well as baseplate 211 and housing 212. The only difference between FIGS. 14 and 15 and FIG. 16 is the handle shapes. An "a" suffix is used for the items in FIG. 16 that are affected by this difference. Securely connected to the concave (frustoconical) surface 213 of baseplate 211 is a flexible handle 214. Handle 214 is constructed and arranged like a bail handle with side portions 215 and 216 that are designed to be pulled toward each other for grasping while the center portion remains fixed and securely connected to surface 213. As side portions 215 and 216 are lifted up from their planar position and pulled toward each other, they provide a suitable means for grasping by the user of the rotor assembly in order to pull the rotor assembly 210 out of the centrifuge structure. The connection portions 217 and 218 define where handle 214 is anchored to surface 213 so as to allow the side portions to remain free for the desired movement. The connection points 217 and 218 are anchored to surface 213 in a manner sufficient to handle the weight of rotor assembly 210 without breaking off or coming loose. By selecting a flexible material for handle 214 with a degree of stiffness as well as resiliency, the side (gripping) portions 215 and 216 readily return to their flat form (see FIGS. 14 and 16) when released. In FIGS. 14 and 15, the handle has a square form while in FIG. 16 handle 220 has a circular form.

While the invention has been illustrated and described in detail in the drawings and foregoing description, the same is to be considered as illustrative and not restrictive in character, it being understood that only the preferred embodiment has been shown and described and that all changes and modifications that come within the spirit of the invention are desired to be protected.

The invention claimed is:

1. A removable, spiral vane insert for receipt by a rotor enclosure of a fluid-processing centrifuge, the fluid processing centrifuge having a centrifuge housing and the rotor having an axis of rotation relative to said centrifuge housing, said removable, spiral vane insert comprising:

a unitary, molded plastic spiral vane portion including a spiral vane module and a baseplate, said spiral vane module including a tubular sleeve having a longitudinal axis coinciding with the axis of rotation of said rotor; and a unitary, molded plastic housing joined to said baseplate for enclosing said spiral vane module; and said housing includes an annular protrusion and said baseplate defines an annular receiving slot for receipt of said annular protrusion.

2. The removable, spiral vane insert of claim 1 wherein said spiral vane module includes a plurality of uniformly spaced vanes, each vane of said plurality being integrally joined to said tubular sleeve as part of said unitary construction.

3. The removable, spiral vane insert of claim 2 wherein each vane of said plurality being integrally joined to said baseplate as part of said unitary construction.

4. The removable, spiral vane insert of claim 1 wherein said baseplate portion defines a plurality of flow holes that are located in close proximity to said tubular sleeve.

5. The removable, spiral vane insert of claim 4 wherein there is one flow hole positioned between each pair of adjacent vanes.

6. The removable, spiral vane insert of claim 1 wherein each vane of said plurality being integrally joined to said baseplate portion as part of said unitary construction.

7. The removable, spiral vane insert of claim 1 wherein said baseplate portion defines a plurality of flow holes that are located in close proximity to said tubular sleeve.

8. The removable, spiral vane insert of claim 7 wherein there is one flow hole positioned between each pair of adjacent vanes.

9. A rotor assembly for use as part of a fluid-processing centrifuge, said rotor assembly having an axis of rotation and comprising:

a rotor base;

a rotor housing removably assembled to said rotor base for defining a rotor enclosure with a hollow interior;

a removable, spiral vane insert assembled into said rotor enclosure;

a unitary, molded plastic spiral vane portion including a spiral vane module and a baseplate, said spiral vane module including a tubular sleeve having a longitudinal axis coinciding with the axis of rotation of said rotor assembly; and a unitary, molded plastic housing joined to said baseplate for enclosing said spiral vane module.

10. The rotor assembly of claim 9 wherein said spiral vane module includes a plurality of uniformly spaced vanes, each vane of said plurality being integrally joined to said tubular sleeve as part of said unitary construction.

11. The rotor assembly of claim 10 wherein each vane of said plurality being integrally joined to said baseplate as part of said unitary construction.

12. The rotor assembly of claim 11 wherein said housing includes an annular protrusion and said baseplate defines an annular receiving slot for receipt of said annular protrusion.

13. The rotor assembly of claim 12 wherein said baseplate portion defines a plurality of flow holes that are located in close proximity to said tubular sleeve.

14. The rotor assembly of claim 9 which further includes a wiper blade positioned between said spiral vane insert and said rotor housing.

15. The rotor assembly of claim 14 wherein said rotor base includes a center tube extending beyond said rotor housing with a threaded end portion.

16. The rotor assembly of claim 15 wherein a threaded nut is received by said threaded end portion for the assembly of said rotor housing to said rotor base.

17. The rotor assembly of claim 16 wherein said spiral vane insert includes:

a unitary, molded plastic spiral vane portion including a spiral vane module and a baseplate, said spiral vane module including a tubular sleeve having a longitudinal axis coinciding with the axis of rotation of said rotor; and a unitary, molded plastic housing joined to said baseplate for enclosing said spiral vane module.

18. A removable, spiral vane insert for receipt by a rotor enclosure of a fluid-processing centrifuge, the fluid processing centrifuge having a centrifuge housing and the rotor having an axis of rotation relative to said centrifuge housing, said removable, spiral vane insert comprising:

a unitary, molded plastic spiral vane portion including a spiral vane module and a baseplate, said spiral vane module including a tubular sleeve having a longitudinal axis coinciding with the axis of rotation of said rotor; and a unitary, molded plastic housing joined to said baseplate for enclosing said spiral vane module; and said baseplate portion defines a plurality of flow holes that are located in close proximity to said tubular sleeve.

* * * * *